US006883944B2

(12) United States Patent
LeBoeuf

(10) Patent No.: US 6,883,944 B2
(45) Date of Patent: Apr. 26, 2005

(54) COMBINATION PORT COVER AND BOAT LIGHTING APPARATUS

(76) Inventor: Michael J. LeBoeuf, 42 SE. Marlin Ave., Key Largo, FL (US) 33037

( * ) Notice: Subject to any disclaimer, the term of this patent is extended or adjusted under 35 U.S.C. 154(b) by 46 days.

(21) Appl. No.: 10/435,841

(22) Filed: May 12, 2003

(65) Prior Publication Data

US 2004/0228134 A1 Nov. 18, 2004

(51) Int. Cl.[7] ..... B60Q 1/00; F21V 1/00

(52) U.S. Cl. ..... 362/477; 362/258; 362/267; 362/277

(58) Field of Search ..... 362/477, 158, 362/187, 194, 226, 258, 267, 277, 387, 396; 114/177, 178, 66; 340/984

(56) References Cited

U.S. PATENT DOCUMENTS

| | | | | | |
|---|---|---|---|---|---|
| 1,668,544 | A | | 5/1928 | Armstrong | |
| 1,852,260 | A | | 4/1932 | Perkins | |
| 2,593,171 | A | * | 4/1952 | Morse | 362/477 |
| 4,360,859 | A | * | 11/1982 | Ziaylek, Jr. | 362/477 |
| 4,445,163 | A | * | 4/1984 | Ziaylek, Jr. | 362/267 |
| 4,845,597 | A | | 7/1989 | McCaghren | |
| 4,954,932 | A | * | 9/1990 | Isenga | 362/477 |
| 5,142,457 | A | | 8/1992 | Wehner | |
| 5,216,972 | A | | 6/1993 | Dufrene et al. | |
| 5,268,824 | A | | 12/1993 | Czipri | |
| 5,285,359 | A | | 2/1994 | Czipri | |
| 5,335,149 | A | | 8/1994 | Evans | |
| 6,241,361 | B1 | * | 6/2001 | Thrasher et al. | 362/387 |

* cited by examiner

*Primary Examiner*—Thomas M. Sember
*Assistant Examiner*—Bao Q Truong
(74) *Attorney, Agent, or Firm*—John Wiley Horton

(57) ABSTRACT

A modified port cover which incorporates a light. The port cover can be screwed into a prior art port and provides the same type of air-tight seal as the prior art cover. A bulb is preferably incorporated in the cover's center. A length of cord extends out the back of the bulb. Splicing components are used to splice the cord into the boat's electrical system, preferably so that the modified port cover is only illuminated when the boat's lights are switched on. The cord is long enough to allow a user to unscrew the modified port cover and use it to illuminate areas some distance away from the port. Alternate embodiments incorporate a handle on the rear of the modified port cover. This handle allows the modified port cover to be gripped like a flashlight once it is removed from the port. A hanging hook may be provided to facilitate hanging of the port cover.

9 Claims, 11 Drawing Sheets

COMBINATION PORT COVER AND BOAT LIGHTING APPARATUS

BACKGROUND OF THE INVENTION

1. Field of the Invention

This invention relates to the field of marine vessels. More specifically, the invention comprises a lighted port cover which can be screwed into a standard prior-art port found on many boats.

2. Description of the Related Art

Marine vessels typically have several enclosed volumes used for storage, repairs, or additional buoyancy. These volumes must be periodically accessed for cleaning, venting, removing stored items, or other purposes. FIG. 1 shows a common construction used on modern boats. Deck 58 is bounded toward the stern by transom 12. It is bounded on the side by gunwale 14. Gunwale 14 often contains an enclosed air space. Thus, it is common in the prior art to place port 16 on a vertical surface of gunwale 14.

FIG. 2 shows port 16 with cover 18 removed. Cover 18 typically attaches to port 16 by engaging male threads 26 with female threads 24. The user employs grips 20 to grasp and spin cover 18 into its home position, whereupon sealing ring 28 preferably creates an airtight seal. Port 16 is actually attached to gunwale 14 by fasteners 16. Since it remains in position with respect to the gunwale, sealants can be used to create an airtight seal between port 16 and gunwale 14.

Thus, those skilled in the art will appreciate that port 16 provides access to the open volume within gunwale 14, without compromising the water-tight design of gunwale 14. Those skilled in the art will also know that the space within gunwale 14 is typically used to house electrical wiring, motor controls, and the other components which must run fore and aft.

Those skilled in the art will know that a variety of mechanical engagement features are used to secure port covers to ports. The threaded engagement shown throughout this disclosure is common, but quarter-turn and snapping engagements are also employed. The present invention is not functionally linked to the type of mechanical engagement employed. Thus, the reader should bear in mind that it can be used with any type of engagement between port cover 18 and port 16.

BRIEF SUMMARY OF THE PRESENT INVENTION

The present invention comprises a modified port cover which incorporates a light. The port cover can be screwed into a prior art port and provides the same type of air-tight seal as the prior art cover. A bulb is preferably incorporated in the cover's center. A length of cord extends out the back of the bulb. Splicing components are used to splice the cord into the boat's electrical system, preferably so that the modified port cover is only illuminated when the boat's lights are switched on. The cord is long enough to allow a user to unscrew the modified port cover and use it to illuminate areas some distance away from the port. Alternate embodiments incorporate a handle on the rear of the modified port cover. This handle allows the modified port cover to be gripped like a flashlight once it is removed from the port. Another alternate embodiment includes a hanging hook, allowing the light to be suspended.

REFERENCE NUMERALS IN THE DRAWINGS

| | | | |
|---|---|---|---|
| 10 | boat | 12 | transom |
| 14 | gunwale | 16 | port |
| 18 | port cover | 20 | grip |
| 22 | fastener | 24 | female thread |
| 26 | male thread | 28 | sealing ring |
| 30 | courtesy light | 32 | modified cover |
| 34 | through bore | 36 | lens |
| 38 | threaded shaft | 40 | bulb |
| 42 | bulb mount | 44 | nut |
| 46 | cord | 48 | light |
| 50 | spring clip | 52 | receiver |
| 54 | U-handle | 56 | straight handle |
| 58 | deck | 60 | switch |
| 62 | hanging hook | 64 | focusing handle |
| 66 | handle half | 68 | bulb securement |
| 70 | female thread | | |

DESCRIPTION OF THE INVENTION

Figure 1:
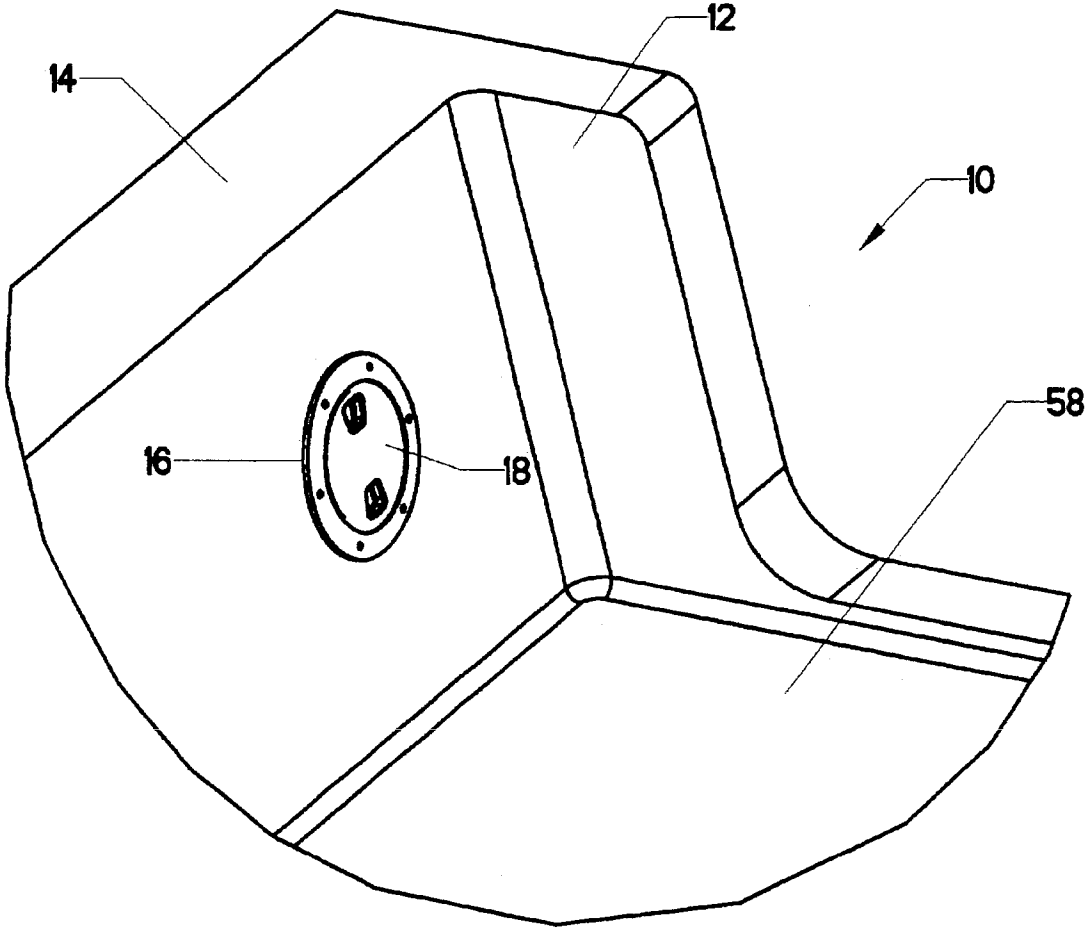
FIG. 1 (PRIOR ART)
FIG. 1 is an isometric view, showing a prior art port.
Figure 2:
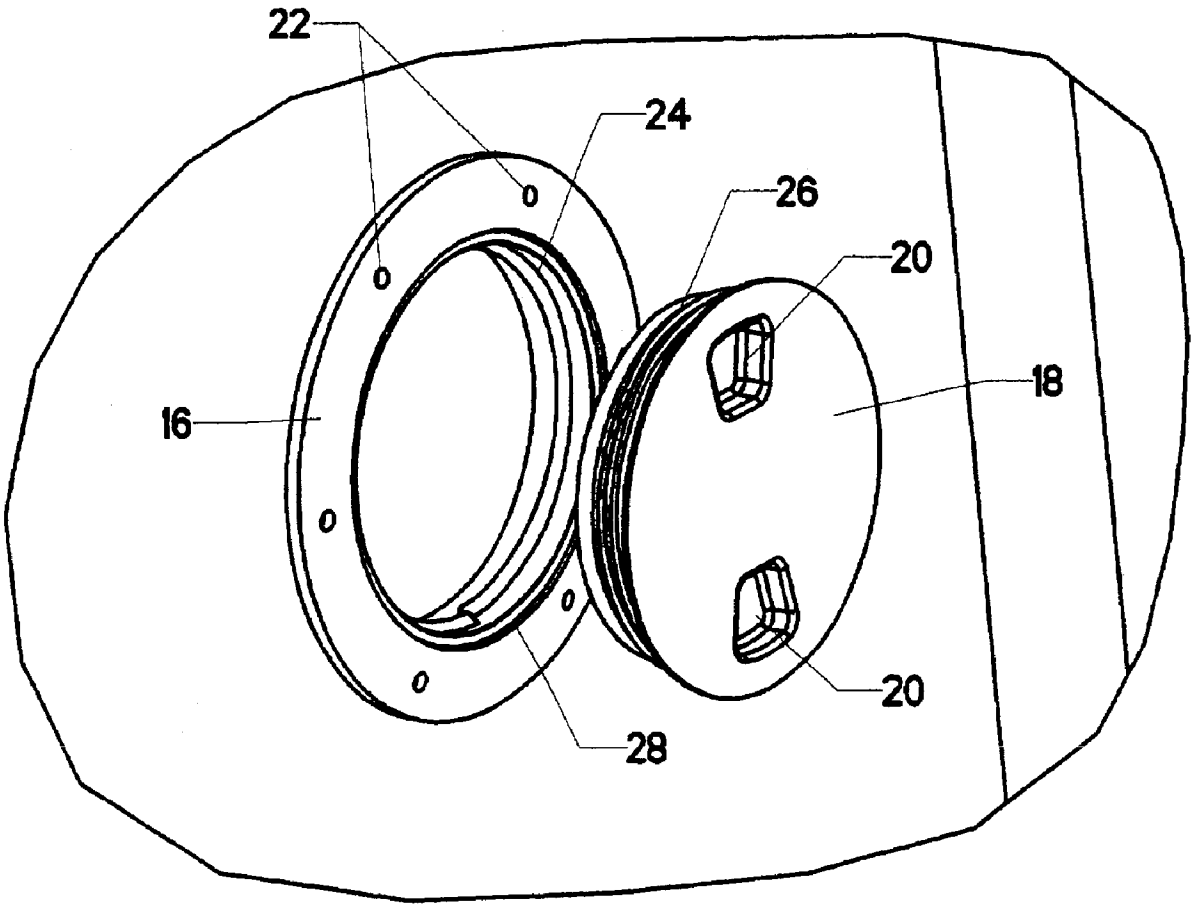
FIG. 2 (PRIOR ART)
FIG. 2 is an isometric view, showing a prior art cover removed from a port.
Figure 3:
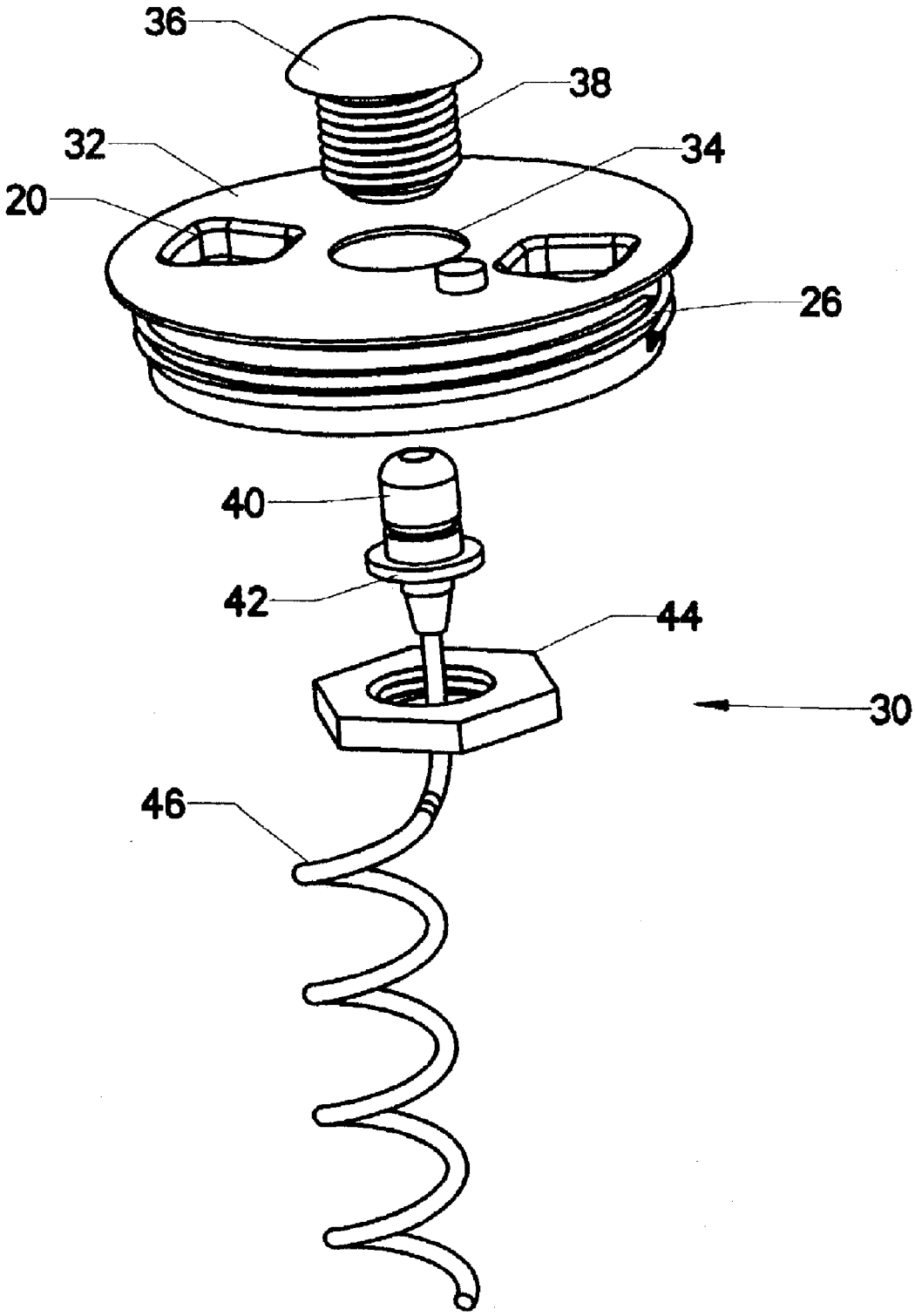
FIG. 3 is an exploded isometric view, showing the present invention.

FIG. 3 shows one embodiment of the present invention in exploded form. Courtesy light 30 (which refers to the entire assembly) has modified cover 32 as its main component. Modified cover 32 is basically identical to the prior art cover 18. However, through bore 34 has been added to accommodate the addition of lighting features. Lens 36 and threaded shaft 38 are made from transparent or translucent material (typically molded as one integral piece). Lens 36 has threaded shaft 38 descending from its lower surface.

Threaded shaft 38 fits into through bore 34. Bulb 40 slides into a hollow interior within lens 36. A flange on bulb mount 42 bears against the lower surface of threaded shaft 38, arresting further progress of bulb 40 into the interior of lens 36. Bulb 40 is held firmly by bulb mount 42, which also provides electrical connections between bulb 40 and cord 46. Nut 44 is slipped over cord 46 and thereafter threaded onto threaded shaft 38. When tightened, nut 44 locks bulb 40, bulb mount 42, and lens 36 to modified cover 32.

Figure 4:
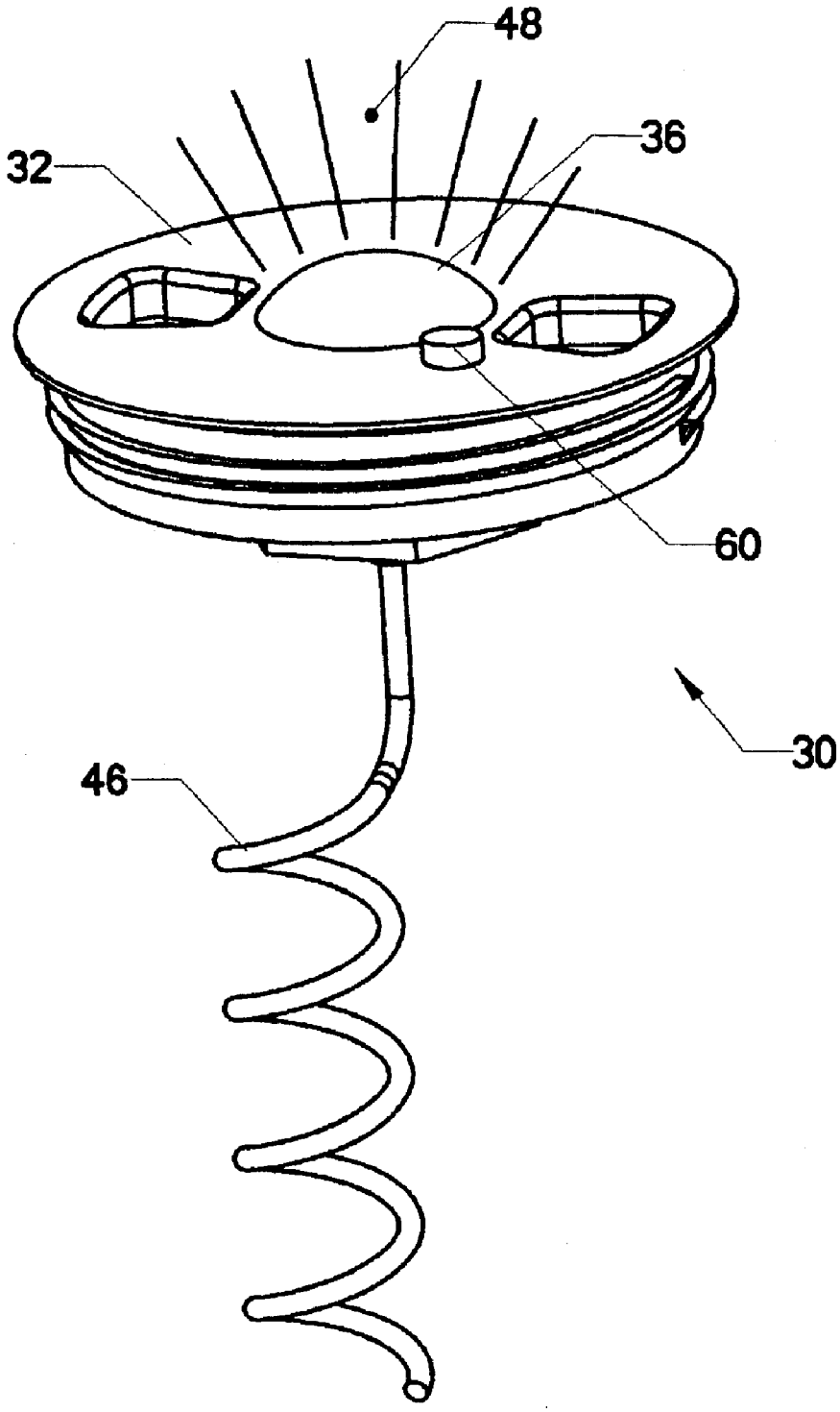
FIG. 4 is an isometric view, showing the present invention in its assembled state.

FIG. 4 shows the completed assembly. Cord 46 typically contains two conductors. These are spliced to the boat's electrical system in order to provide power to bulb 40. One convenient source of power is to splice the conductors to the wires powering the boat's navigation lights. In that case, bulb 40 is only illuminated when the navigation lights are turned on. Some boats are equipped with a separate courtesy light switch mounted on the dash. If courtesy light 30 is powered by a circuit connected to this switch, then no additional switch is needed on courtesy light 30 itself, i.e., it will simply be turned on and off by the switch on the boat's dashboard.

In some instances, however, courtesy light 30 may be powered by a non-switched power source, or by a circuit which is powered any time the boat is in use. For these occasions (which may be rare), it is desirable to provide switch 60, which allows a user to switch the device on and off directly. FIG. 4 shows switch 60 in the "ON" position, with light 48 being emitted through lens 36. While several views show the inclusion of a switch 60, the reader should be aware that such a switch may be omitted in most installations.

Those skilled in the art will realize that many different types of light can be produced (i.e., diffused, focused, bright, dim, etc.). The embodiment shown in FIG. 4 uses a highly convex lens to scatter the light broadly. This provides diffused lighting over a relatively large area. Modified cover 32 can be broadly characterized as having an inward facing side and an outward facing side. The inward facing side faces into the port (downward in the view as shown). The outward facing side aces away from the port (upward in the view as shown). As the object of the invention is generally to provide light to the areas of the boat occupied by the users, the light source should be configured to shine out from the outward facing side. This may be done directly (pointing the bulb outward) or indirectly (pointing the bulb inward and using reflective surfaces to scatter the light back out).

Figure 3B:
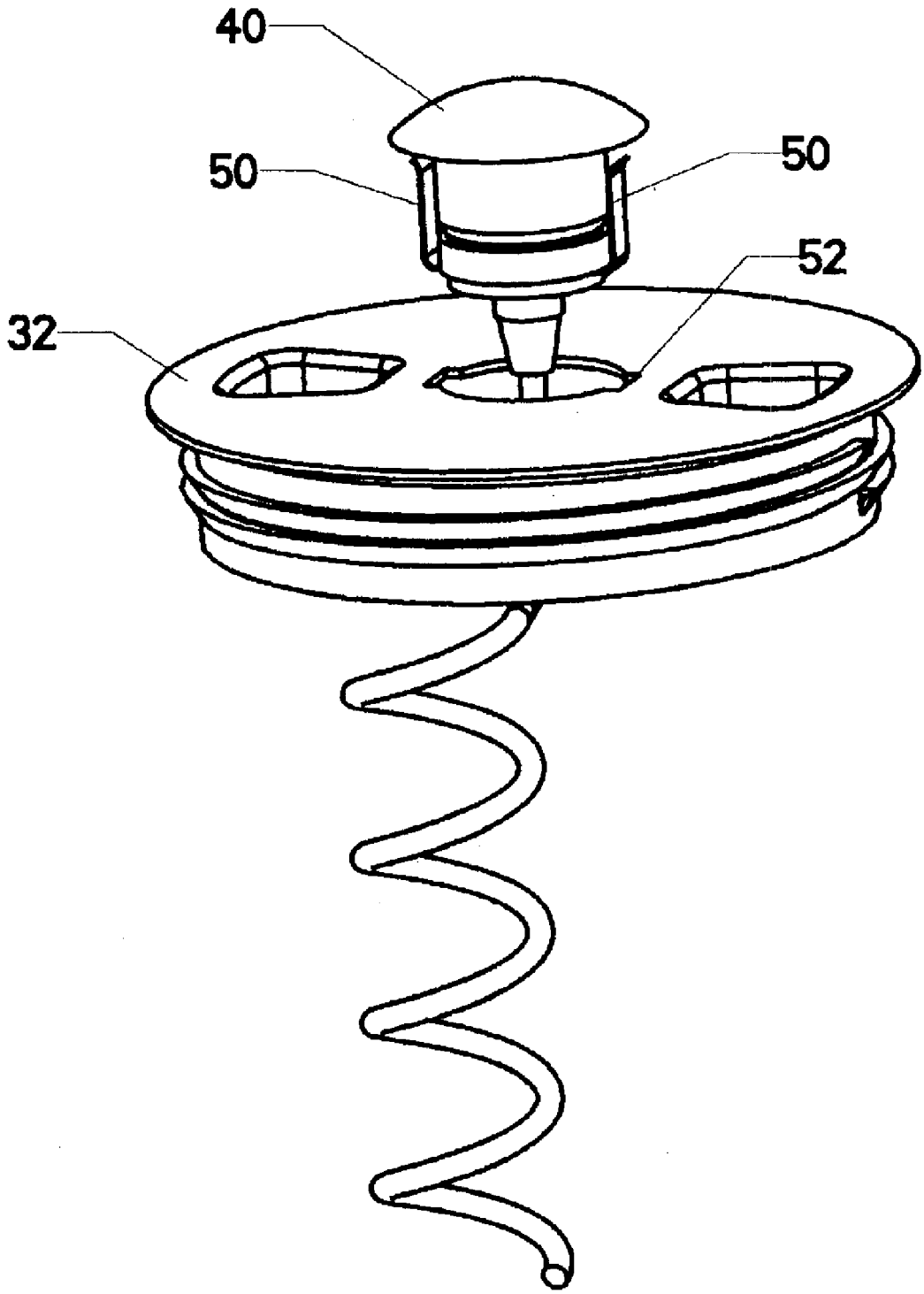
FIG. 3B is an exploded isometric view, showing the present invention.

Those skilled in the art will also realize that a wide variety of lenses and light sources can be employed. FIG. 3 shows an incandescent bulb. Fluorescent bulbs and LED's could also be employed. Many types of mounting systems are also known in the art of lighting. FIG. 3B shows an alternate embodiment. Rather than a lens and a separate bulb, this particular embodiment of bulb 40 is an integrated unit having two spring clips 50 attached thereto. It is pushed into receiver 52, where the two spring clips 50 snap outward and lock the assembly in position.

Figure 5:
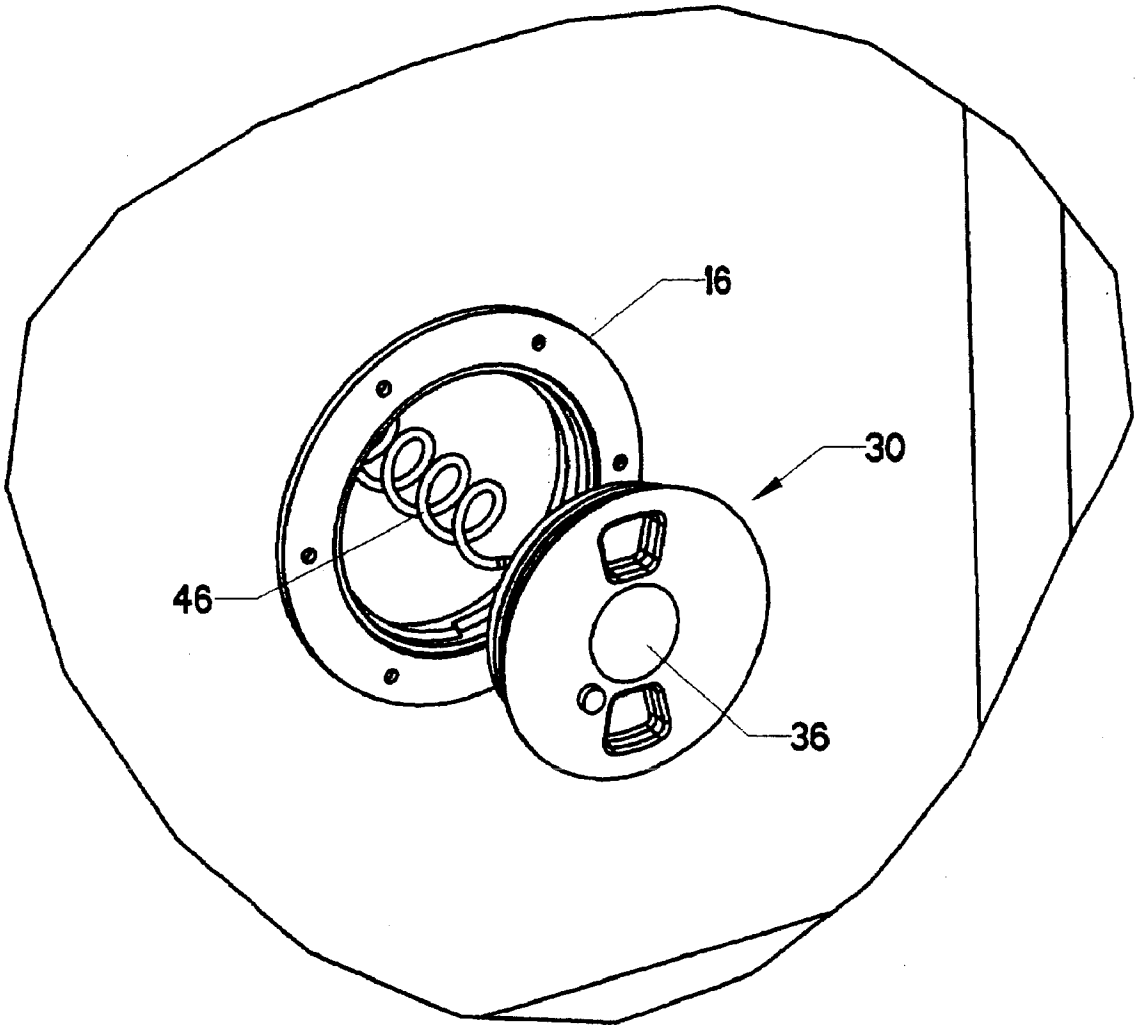
FIG. 5 is an isometric view, showing the present invention in use.
Figure 6:
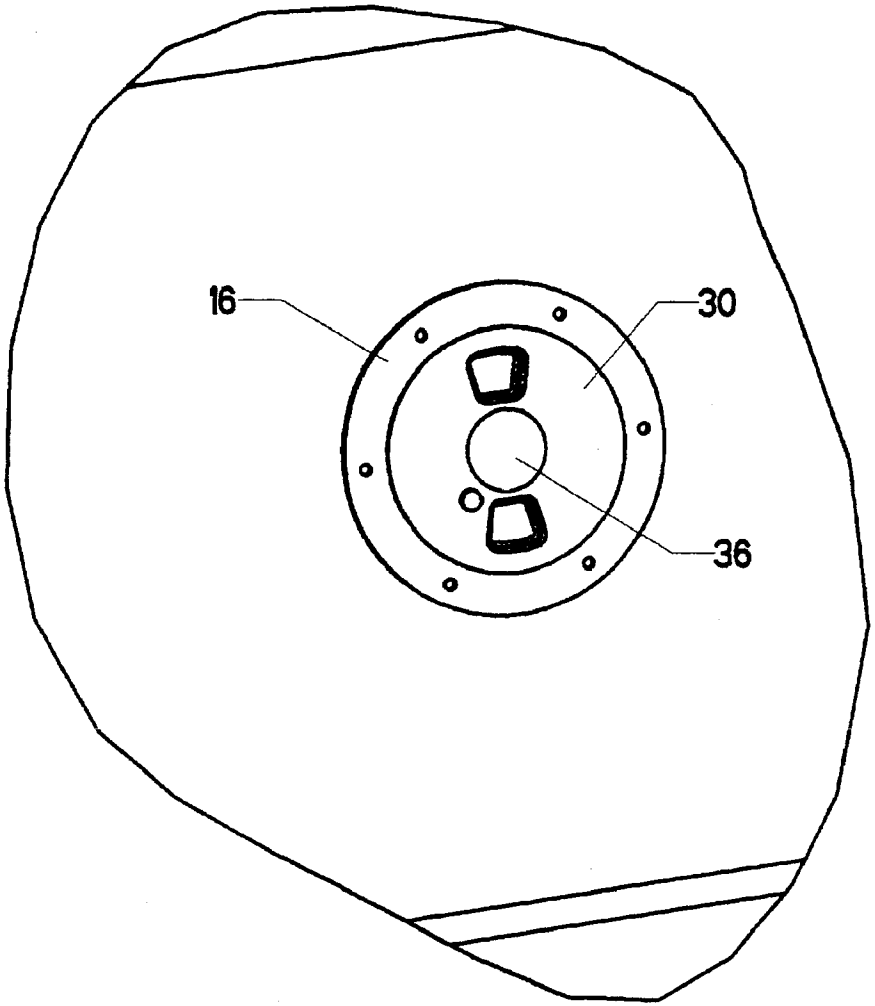
FIG. 6 is an isometric view, showing the present invention in use.

FIG. 5 shows the invention actually installed on a boat. Cord 46 has been electrically connected to conductors lying within the cavity behind port 6. Courtesy light 30 is thereby provided with power so that light is emitted through lens 36 even when the device is not seated within port 16. FIG. 6 shows courtesy light 30 seated within port 16. When switched on, light emanating from lens 36 will shine outward and illuminate the surrounding areas of the boat.

Returning briefly to FIG. 5, the reader will appreciate that the user may wish to use courtesy light 30 like a flashlight. That is, the user may unscrew courtesy light 30 and move it some distance away from port 16 in order to shine light on a map or other object. While the version shown in FIG. 5 works for this purpose (since coiled cord 46 can be made to extend for considerable distance), more convenient gripping features may be preferred.

Figure 7:
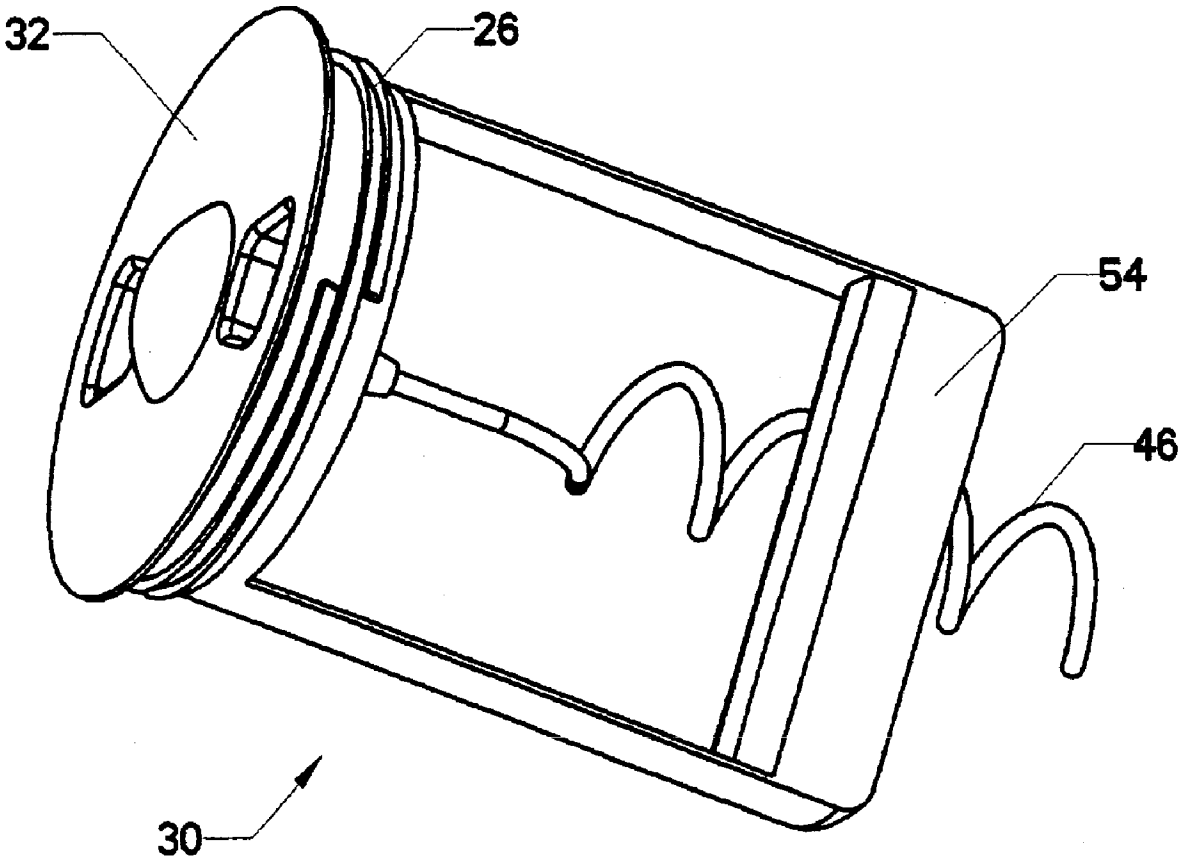
FIG. 7 is an isometric view, showing an alternate embodiment.
Figure 8:
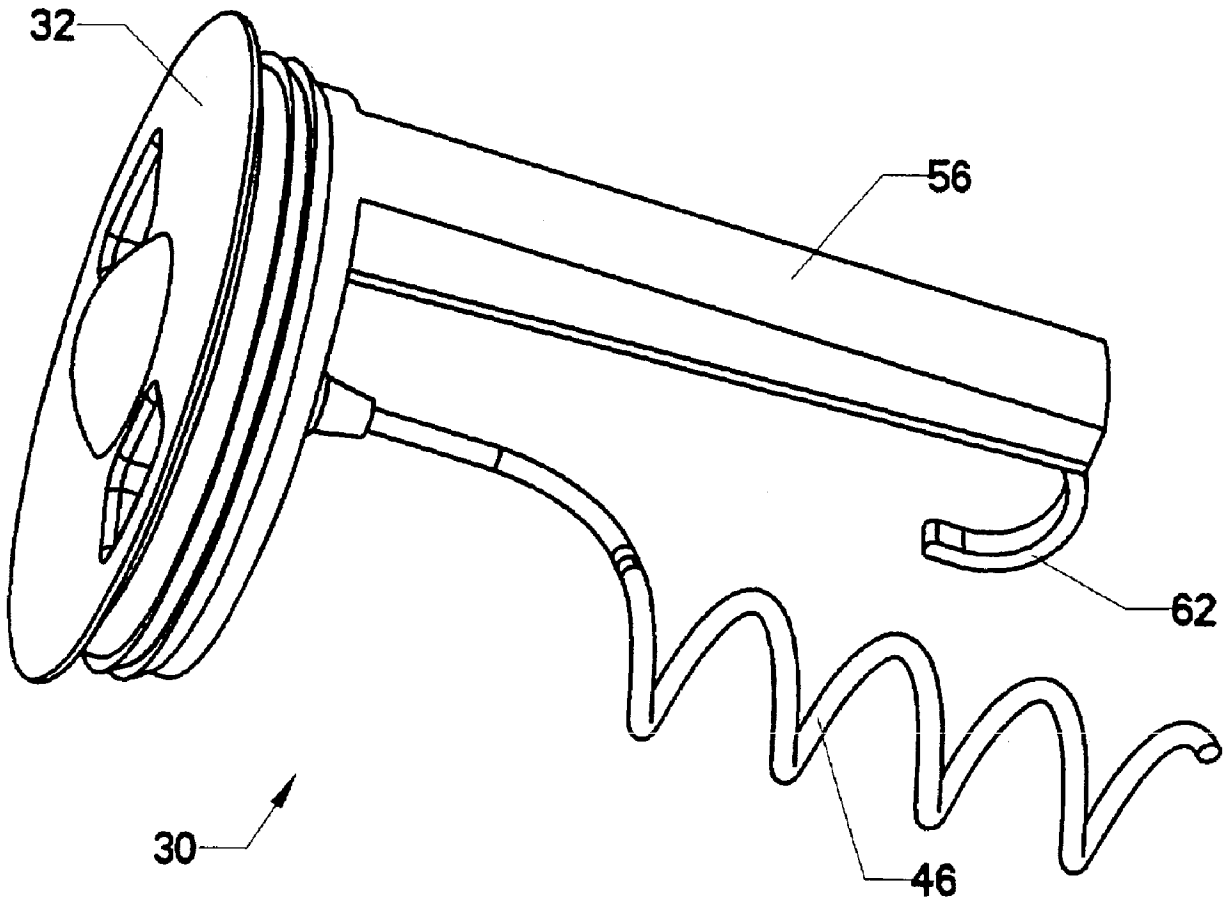
FIG. 8 is an isometric view, showing an alternate embodiment.

FIG. 7 shows an embodiment of courtesy light 30 in which U-handle 54 has been added to the inward facing side of modified cover 32. The same type of gripping features are found on the outward facing side. When installed in a port, the embodiment shown in FIG. 7 is indistinguishable from the prior embodiments. However, once the user removes the device from the port, the user can employ U-handle 54 to hold courtesy light 30 and point it in a desired direction—much like a flashlight. FIG. 8 shows a simpler embodiment of the same concept—with straight handle 56 being substituted for U-handle 54.

Hanging hook 62 may be provided on straight handle 56. It allows the light to be hung from a railing or other convenient position in order to allow hands-free operation.

Figure 9:
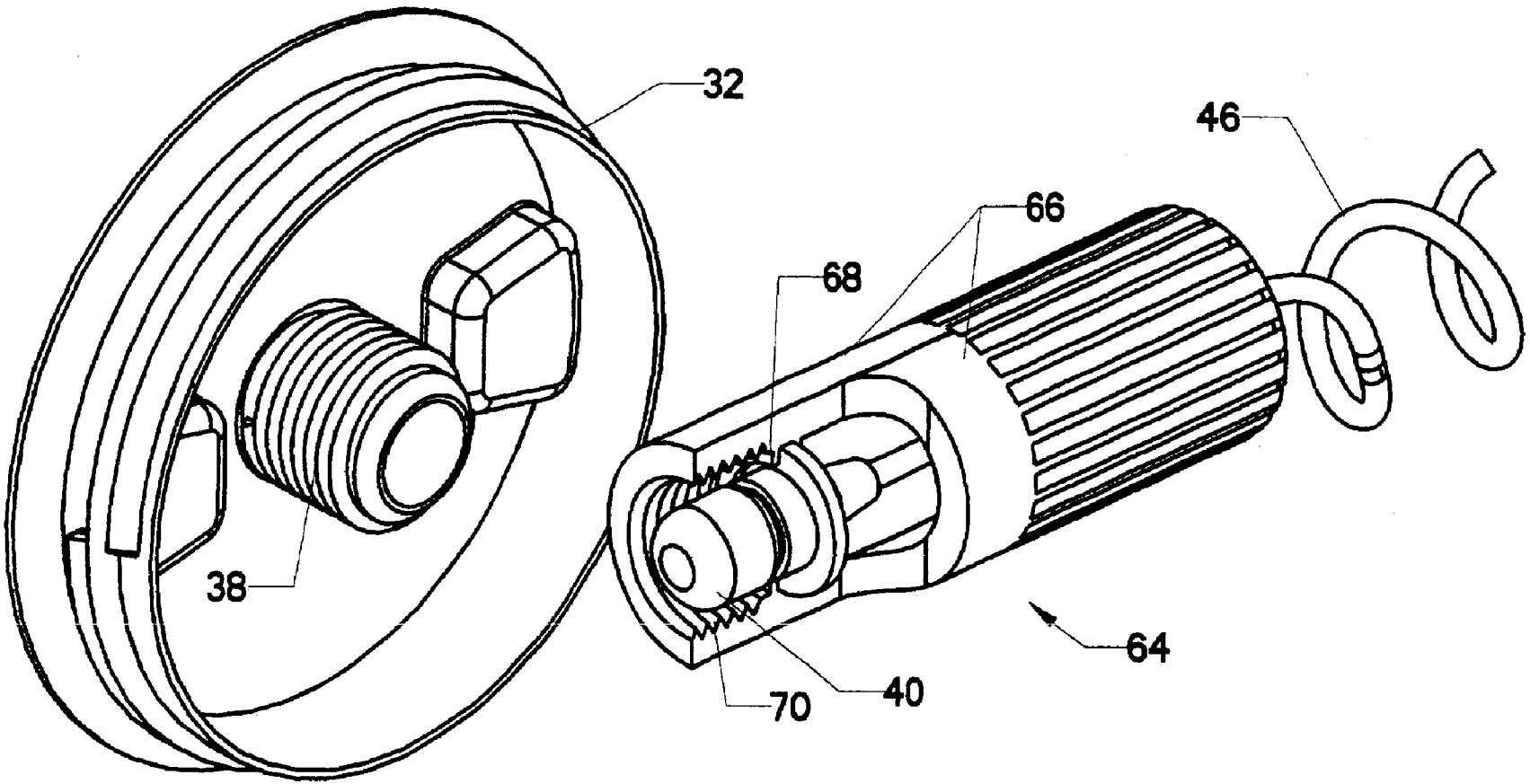
FIG. 9 is an isometric view, showing an exploded view of an alternate embodiment.

More advance features can be incorporated into the courtesy light. The previously disclosed versions employ lens 36 to focus the light emitted by bulb 40. Those skilled in the art will know that if the distance between bulb 40 and lens 36 is varied, the pattern of light projected will vary as well. FIG. 9 shows an alternate embodiment incorporating this feature. Focusing handle 64 is provided. It is formed by securing two handle halves 66 together (The handle half 66 nearest the viewer includes a cutaway to aid visualization). The two halves may be secured using snaps, screws, adhesives, or other similar known devices. The internal surfaces of the two handle halves 66 incorporate bulb securement 68 and female thread 70. When the two halves are assembled, they secure bulb 40 in the position shown. Cord 46 passes through the device's hollow interior.

The inward-extending portion of lens 36 includes threaded shaft 38 (which is hollow). The user installs focusing handle 64 by threading female thread 70 onto threaded shaft 38. As the user continues turning focusing handle 64, bulb 40 will be advanced further into threaded shaft 38, and therefore closer and closer to lens 36.

Figure 10:
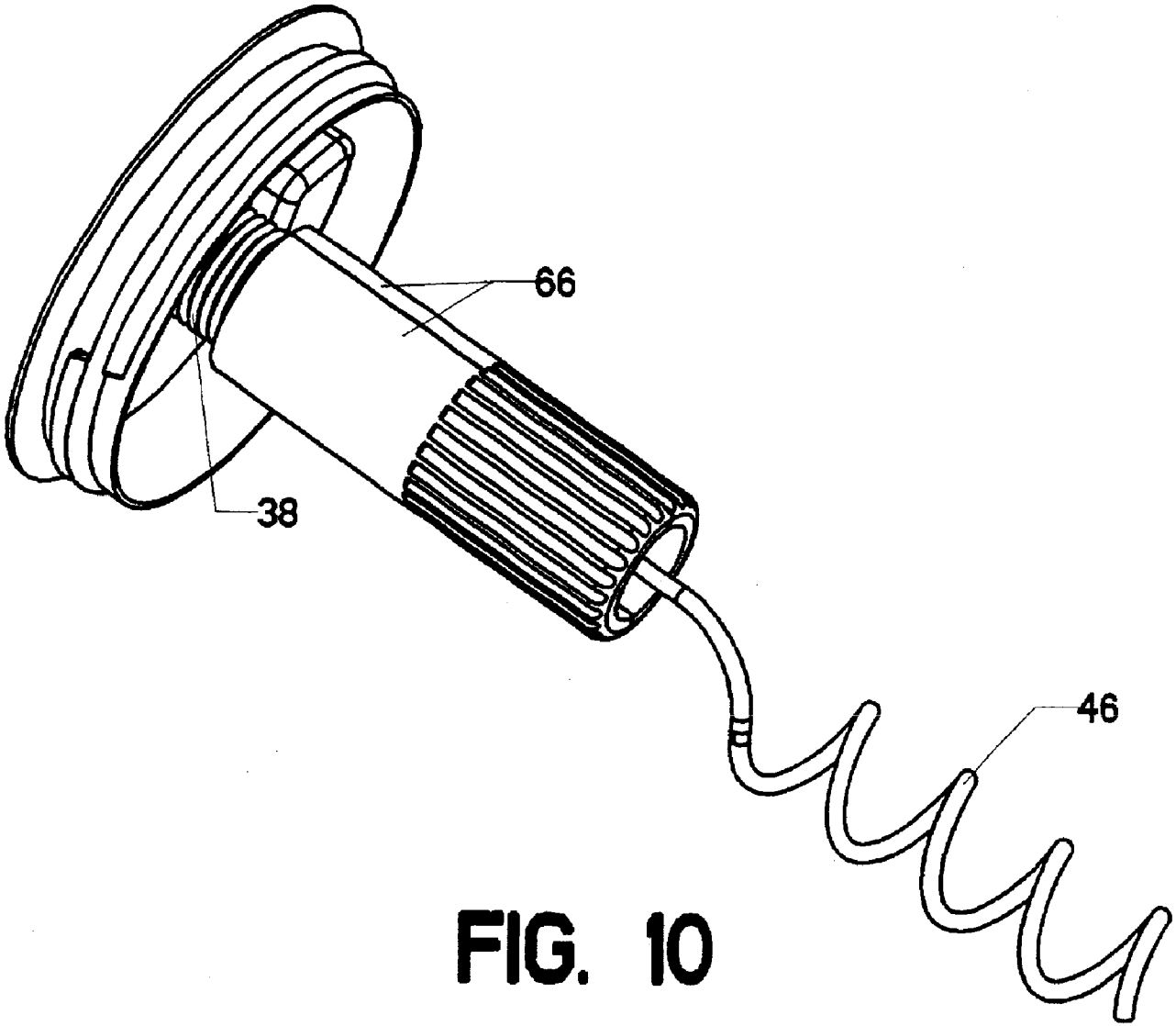
FIG. 10 is an isometric view, showing the embodiment of FIG. 9 in its assembled state.

FIG. 10 shows the device in its assembled state, with the two handle halves 66 threaded over threaded shaft 38. If the user rotates focusing handle 64, the distance between bulb 40 and lens 36 will be adjusted, thereby adjusting the pattern of light thrown.

Those skilled in the art will know that the devices shown can be injection molded using a variety of thermoplastics. Pigments and surface diffusion can be employed to create an opaque, translucent, or transparent version of modified cover 32.

Although the preceding descriptions contain significant detail they should not be viewed as limiting the invention but rather as providing examples of the preferred embodiments of the invention. As an example, many known distance adjusting mechanisms could be substituted for the threaded adjustment used in focusing handle 64. Accordingly, the scope of the invention should be determined by the following claims, rather than the examples given.

Having described my invention, I claim:

1. A lighted port cover which a user can place within a port on a boat, wherein said port includes a large circular opening containing a female thread disposed about said large circular opening, and wherein said boat includes electrical power means, comprising:

a. a circular port cover, having an outward facing side, an inward facing side, and a male thread disposed about said circular port cover configured to engage said female thread on said port;

b. light producing means attached to said port cover and positioned to cast light out said outward facing side;

c. connecting means for connecting said light producing means on said port cover to said electrical power means on said boat; and d. wherein said circular cover is sized to completely seal said large circular opening in said port when said male thread on said circular port cover is threaded into said female thread on said port.

2. A lighted port cover as recited in claim 1, wherein said port cover is made from transparent material.

3. A lighted port cover as recited in claim 1, wherein said outward facing side includes a gripping feature allowing said user to grip said port cover in order to remove said port cover from said port.

4. A lighted port cover as recited in claim 1, further comprising a switch allowing said user to selectively connect said light producing means to said power means.

5. A lighted port cover as recited in claim 1, further comprising a handle attached to said inward facing side, so that when said user removes said port cover from said port, said user can use said handle to grasp said port cover.

6. A lighted port cover as recited in claim 1, wherein said connecting means comprises a coiled cord, so that when said user removes said port cover from said port, said port cover can be moved a distance away from said port while said light producing means remains connected to said power means.

7. A lighted port cover as recited in claim 5, wherein said handle further comprises a hanging hook.

8. A lighted port cover as recited in claim 1, further comprising a lens positioned proximate said light producing means in order to alter said light cast out said outward facing surface.

9. A lighted port cover as recited in claim 8, wherein the position of said lens is adjustable with respect to the position of said light producing means.

* * * * *

UNITED STATES PATENT AND TRADEMARK OFFICE

CERTIFICATE OF CORRECTION

PATENT NO. : 6,883,944 B2
DATED : April 26, 2005
INVENTOR(S) : Sheryl Grogg

It is certified that error appears in the above-identified patent and that said Letters Patent is hereby corrected as shown below:

Title page,
Item [22], PCT Filed, "Aug. 18, 2003" should be deleted and -- August 15, 2003 -- inserted therefor.

Signed and Sealed this

Thirteenth Day of December, 2005

JON W. DUDAS
*Director of the United States Patent and Trademark Office*